United States Patent [19]

Rose

[11] Patent Number: 4,575,592

[45] Date of Patent: Mar. 11, 1986

[54] ELECTRICAL SWITCH

[75] Inventor: William H. Rose, Harrisburg, Pa.

[73] Assignee: AMP Incorporated, Harrisburg, Pa.

[21] Appl. No.: 684,530

[22] Filed: Dec. 21, 1984

[51] Int. Cl.[4] ..... H01H 13/00; H01H 19/00

[52] U.S. Cl. ..... 200/6 R; 200/6 C; 200/303; 200/339

[58] Field of Search ..... 200/1 A, 1 TK, 5 R, 200/6 R, 6 B, 6 BA, 6 BB, 6 C, 8 R, 8 A, 11 G, 11 J, 11 K, 65, 67 D, 67 DA, 67 DB, 68.1–68.3, 155 A, 246, 291, 302.3, 303, 307, 315, 339

[56] References Cited

U.S. PATENT DOCUMENTS

| | | | |
|---|---|---|---|
| 3,221,131 | 11/1965 | Bury | 200/307 |
| 3,588,409 | 1/1971 | Lattinen | 200/291 X |
| 4,024,362 | 5/1977 | Morgan et al. | 200/339 X |
| 4,359,611 | 11/1982 | Haskins | 200/339 X |
| 4,412,108 | 10/1983 | McCarty | 200/6 R X |
| 4,417,106 | 11/1983 | Gingerich et al. | 200/6 R X |
| 4,496,802 | 1/1985 | Rose et al. | 200/5 R |

*Primary Examiner*—J. R. Scott

*Attorney, Agent, or Firm*—Adrian J. LaRue; Anton P. Ness

[57] ABSTRACT

A switch comprises a dielectric housing having electrical contact members secured in a base thereof with one of the contact members including a stationary contact section and the other of the contact members having a movable contact section. The contact sections are disposed in a profiled arcuate inner surface formed by the base and resilient sections of the housing. A dielectric actuator having a cavity and an external arcuate surface mates with the arcuate inner surface. The surfaces are movable relative to each other when the actuator has been mounted on the housing with the contact sections being disposed in the cavity. The resilient sections of the housing maintain the actuator on the housing. The movable contact section is disposed in a section of the actuator cavity and is movable into and out of electrical engagement with the stationary contact section upon movement of the actuator from one position to another position. A detent arrangement is provided between the actuator and the housing to maintain the actuator in either position.

14 Claims, 13 Drawing Figures

ELECTRICAL SWITCH

FIELD OF THE INVENTION

This invention relates to electrical switches and more particularly to electrical switches of the type for use on printed circuit boards.

BACKGROUND OF THE INVENTION

Posts in printed circuit boards are used in some cases to change codes between integrated circuits on the boards by electrically connecting the posts to a ground plane and a specified voltage level. Wires are wire-wrapped onto the posts which are then electrically connected to selected pins of the integrated circuits. If the codes are to be changed, the wires must be reconnected. This is a cumbersome arrangement.

Dual in-line and single in-line package switches can be used on printed circuit boards to readily change codes between integrated circuits on the boards. These switches are normally made with four or eight positions which would take care of boards requiring these numbers of code-changing positions. For the boards requiring two or three or five through seven positions, the DIP or SIP switches would take up valuable room on the boards for the switch positions that would not be used.

A switch is therefore needed that can be used on printed circuit boards either by itself or grouped together with other like switches to change codes for integrated circuits or perform other necessary switching operations without taking up essential space on the boards and which is simple in structure and is easy to manufacture and assemble.

SUMMARY OF THE PRESENT INVENTION

According to the present invention, a switch comprises a dielectric housing having electrical contact members secured in a base thereof with one of the contact members including a stationary contact section and the other of the contact members having a movable contact section, the contact sections being disposed in a cavity formed by a profiled arcuate inner surface formed by the base and resilient sections of the housing. A dielectric actuator has a cavity and an external arcuate surface matable with the arcuate inner surface and movable relative to each other when the actuator has been mounted on the housing with the contact sections being disposed in the cavity, the resilient sections of the housing maintaing the actuator in the housing. The movable contact section is disposed in a section of the cavity and is movable into and out of electrical engagement with the stationary contact section upon movement of the actuator from one position to another position. A detent arrangement is provided between the actuator and the housing to maintain the actuator in the one or other position.

According to an embodiment of the present invention, the actuator includes an actuating section that enables the actuator to be actuated from above or to the side.

According to another embodiment of the present invention, stationary contact sections are disposed on either side of a movable contact section to form a single-pole double-throw switch.

DETAILED DESCRIPTION OF THE INVENTION

Figure 1:
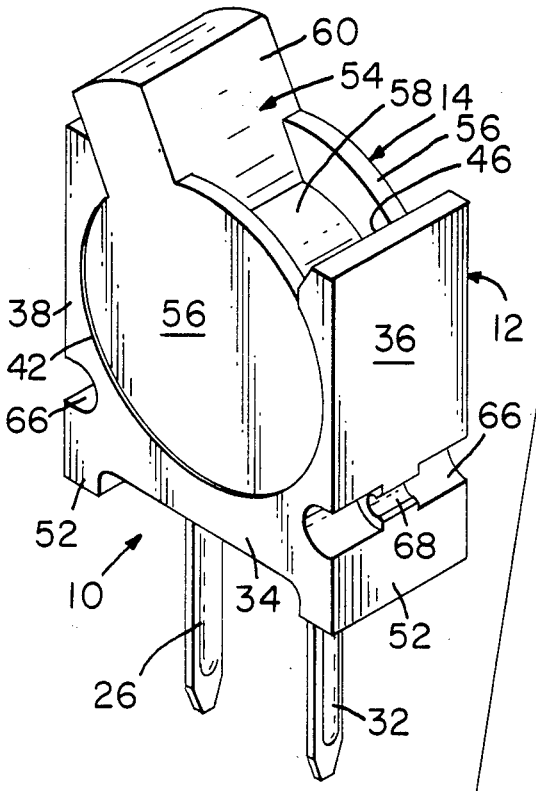
FIG. 1 is a perspective view of the electric switch according to the present invention.
Figure 2:
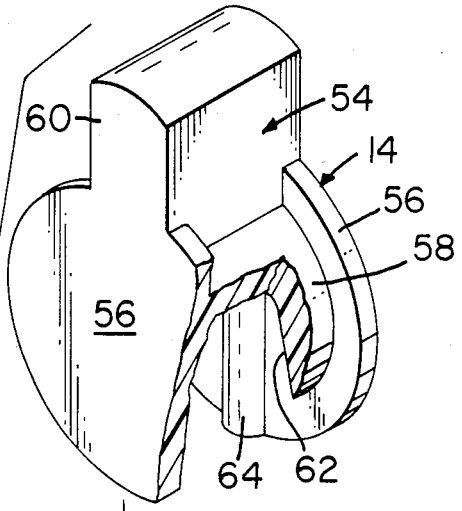
FIG. 2 is a perspective exploded view of the parts of the switch.
Figure 2:
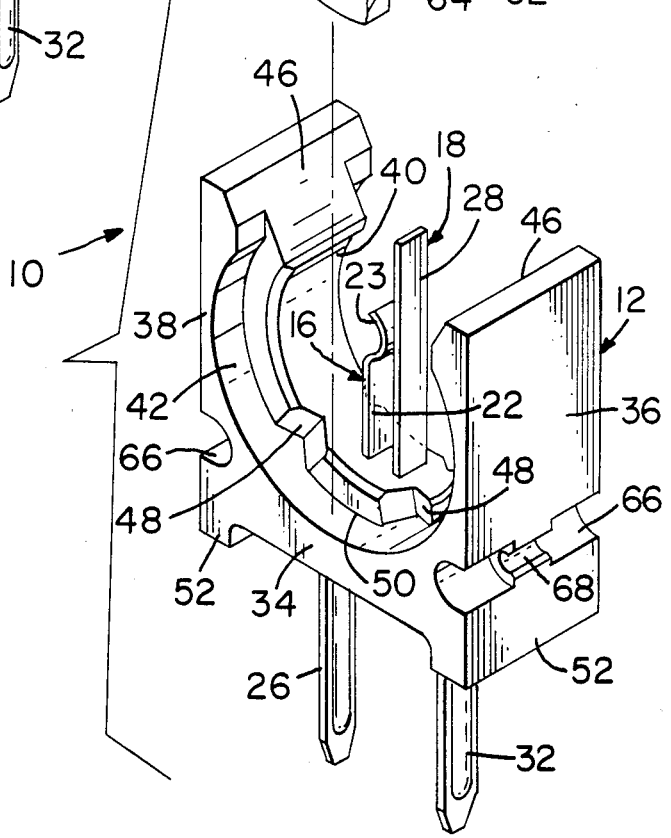

FIGS. 1 through 5 show an electrical switch 10 that includes a dielectric housing 12, a dielectric actuator 14 and electrical contact members 16, 18 secured in housing 12.

Figure 3:
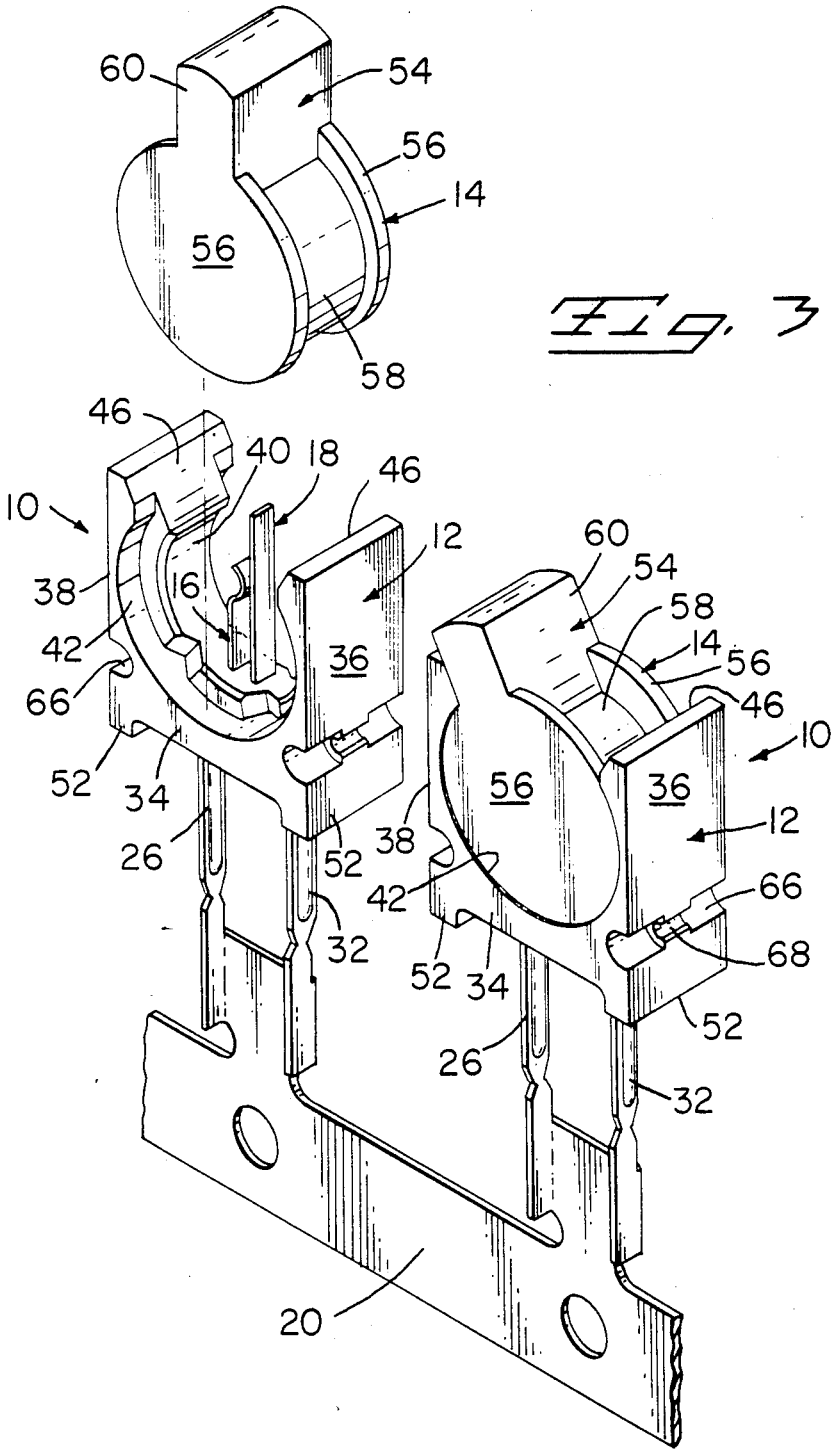
FIG. 3 is a perspective view of switches on a carrier strip with housings molded onto electrical contact members of the carrier strip, one of the housings having an actuator therein forming a completed switch while an actuator is exploded from the other housing.
Figure 4B:
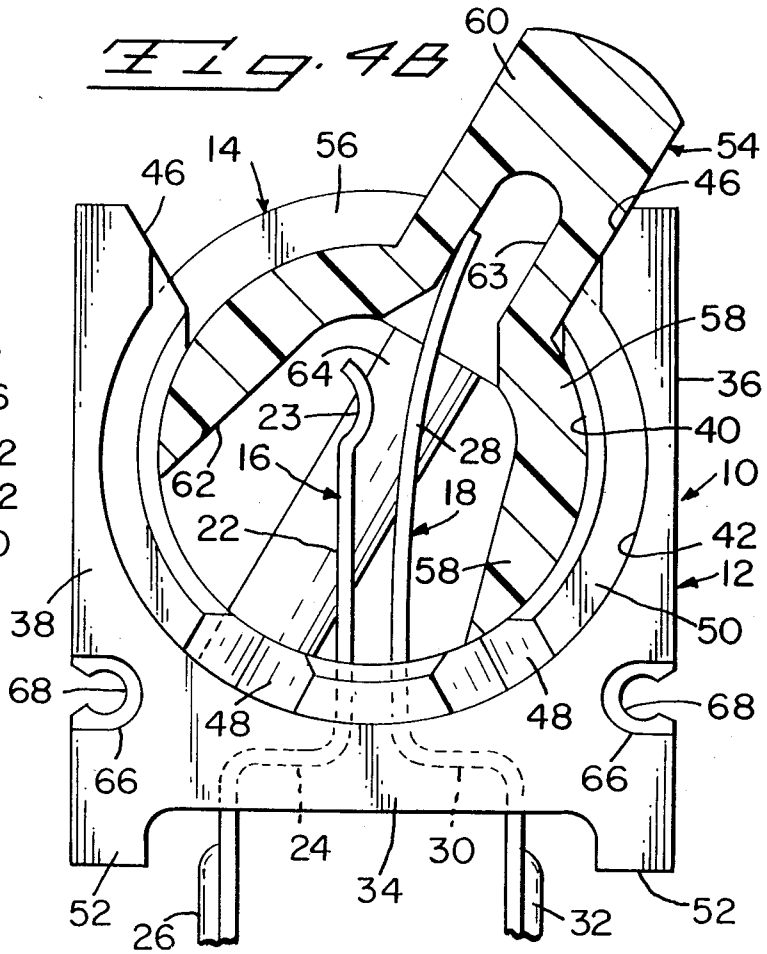
FIGS. 4A and 4B are side elevational views of the switch with the actuator being in cross section showing the switch in operative and inoperative positions.
Figure 4A:
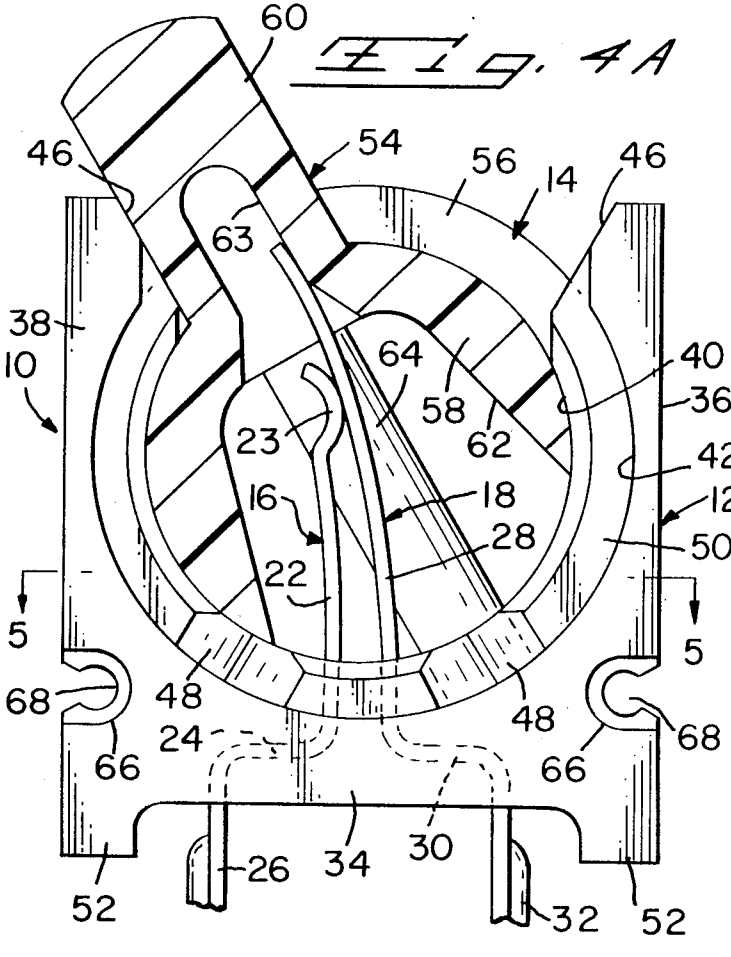
Figure 5:
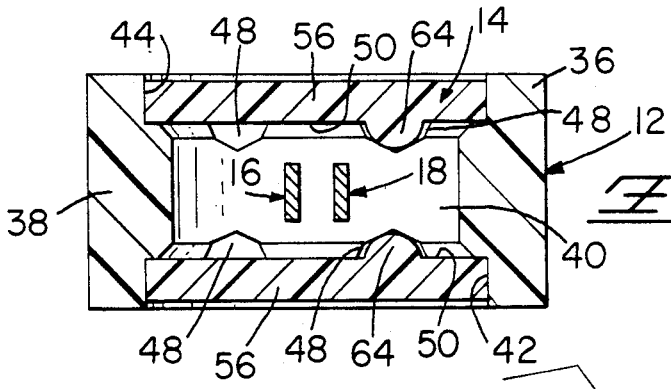
FIG. 5 is a section view taken along line 5—5 of FIG. 4A.

As shown in FIG. 3, electrical contact member 16, 18 are stamped and formed in accordance with conventional stamping and forming practices from a metal strip that has the desirable spring and electrical characteristics and contact members 16, 18 are retained on carrier strip 20. As shown in FIGS. 4A and 4B, electrical contact member 16 includes a stationary contact section 22, a mounting section 24 and a terminal section 26. Electrical contact member 18 includes a movable contact section 28, a mounting section 30 and a terminal section 32. As shown in FIG. 3, terminal sections 26 and 32 of contact members 16, 18 are connectd to carrier strip 20 which can be used to feed contact members 16, 18 into a conventional mold wherein dielectric housings 12 are insert-molded onto contact members 16, 18 via mounting sections 24, 30, whereafter dielectric actuators 14 which have been molded in a separate mold can be inserted onto housings 12 completing the assembly of electrical switches 10 as shown in FIGS. 1, 3, 4A and 4B. Completely assembled electrical switches 10 can remain on carrier strip 20 during the assembly thereof and they then can be tested while still in position on carrier strip 20 by severing one of terminal sections 26, 32 therefrom, applying a ground to carrier strip 20 and applying a voltage to the severed terminal section, whereafter actuator 14 is moved from an operative to an inoperative position thereby testing the operation of switches 10 to make sure that they are acceptable.

Housings 12 are molded from a suitable dielectric material havng the desirable dielectric and resilient characteristics. Housing 12 includes a base 34 in which mounting sections 24 and 30 of contact members 16, 18 are sealingly secured and resilient sections 36, 38 extend outwardly from base 34. Base 34 and resilient sections 36, 38 have a continuous inner arcuate surface 40 and outer continuous arcuate surfaces 42, 44. As can be discerned, stationary contact section 22 of electrical contact member 16 and movable contact section 28 of electrical contact member 18 are disposed within inner arcuate surface 40 extending inwardly from base 34. Contact sections 22, 28 are normally out of engagement with one another and the free end of contact section 22 is in the form of an inwardly-directed arcuate contact section 23.

The ends of inner arcuate surface 40 intersect with tapered surfaces 46. Spaced V-shaped recesses 48 are located in surfaces 50 with recesses 48 being disposed on both sides of contact sections 22, 28 at the junctions between resilient sections 36, 38 and base 34 of housing 12 as shown in FIGS. 4A and 4B. Projectios 52 extend outwardly from base 34 and they engage a printed circuit board when electrical switches 10 are mounted thereon with terminal sections 26 and 32 in electrical connection with respective conductive paths thereon thereby spacing switch 10 from the board.

Actuator 14 is molded from a suitable dielectric material having the desirable dielectric and resilient characteristics and can be molded in strip form so as to be inserted into position on housings 12 subsequent to the molding of electrical contact members 16, 18 in position therein to thereby form electrical switches 10. Actuator 14 includes a central bell-shaped section 54 disposed between almost-circular outer sections 56. As shown in FIGS. 4A and 4B, bell-shaped section 54 includes an inner section 58 and an outer section 60. A contact-receiving cavity 62 is located in sections 58, 60 so that stationary contact section 22 is located in the largest part of cavity 62 while movable contact section 28 is disposed in a smaller part 63 of cavity 62 that extends into section 60. The outer surface of inner section 58 is radiussed on both sides of outer section 60 so as to mate with inner arcuate surface 40 and slidably move therealong. Outer section 60 extends outwardly from outer sections 56 and constitutes an operating section for engagement by an operating member for operating actuator 14 in a reciprocatory manner between tapered surfaces 46 for moving movable contact section 28 into electrical engagement with arcuate contact section 23 of stationary contact section 22 as shown in FIG. 4A or out of electrical engagement therewith as shown in FIG. 4B. Outer sections 56 of actuator 14 are disposed along respective outer arcuate suraces 42, 44 and surfaces 50 thereby stabilizing actuator 14 in housing 12 and prevent sidewise movement.

Radiussed projections 64 are disposed on inner surfaces of outer sections 56 in opposed relationship and projections 64 in conjunction with V-shaped recesses 48 in surfaces 50 form a detent arrangement to maintain actuator 14 in an actuated or nonactuated position as shown in FIGS. 4A and 4B. Radiussed projections 64 can be located on surfaces 50 and recesses 48 can be disposed in the inner surfaces of outer sections 56.

When actuator 14 is assembled in position between resilient sections 36, 38 of housing 12, the outer radiussed or arcuate surfaces of inner section 58 of bell-shaped section 54 engage tapered surfaces 46 which cams resilient sections 36, 38 outwardly thereby enabling actuator 14 to be positioned on housing 12 with contact sections 22, 28 being disposed within contact-receiving cavity 62 and the outer radiussed surfaces of inner section 58 to mate with inner arcuate surface 40 while almost-circular outer sections 56 are disposed in respective outer arcuate surfaces 42, 44 against surfaces 50 and outer section 60 is moved into engagement with one of tapered surfaces 46 with opposed radiussed projections 64 being disposed in respective V-shaped recesses 48 thereby maintaining actuator 14 in position until actuator 14 is moved to the other position. Tapered surfaces 48 faciliate assembly of actuators 14 onto housings 12. Since outer sections 56 containing radiussed projections 64 are not connected to bell-shaped section 54 along the areas containing radiussed projections 64, then sections 56 along these areas will flex outwardly when radiussed sections 64 are moved along surfaces 50 between recesses 48 as a result of the resilient characteristics of actuator 14. The detent arrangement must be such that the flexural forces generated by electrically-engaged contact sections 22, 28 as shown in FIG. 4A are less than the detent forces.

FIG. 4A shows switch 10 in an actuated position whereby outer section 60 is in engagement wth tapered surface 46 of section 38 and maintained thereat via radiussed projections 64 being disposed in V-shaped recesses 48 with movable contact section 48 in electrical engagement with arcuate contact section 23. When actuator 14 moves movable contact section 28 in cavity part 63 into electrical engagement with arcuate contact section 23, wiping action takes place therebetween and the free end of movable contact section 28 moves along the surface of cavity part 63 of cavity 62. Movement of section 60 of actuator 14 against tapered surface 46 of section 36 of housing 12 moves movable contact section 28 out of electricl engagement with arcuate contact section 23 and actuator 14 is maintained in this position via radiussed projections 64 being disposed in recesses 48. Thus, switch 10 is either in the actuated position as shown in FIG. 4A or in the nonactuated position as shown in FIG. 4B.

Figure 6:
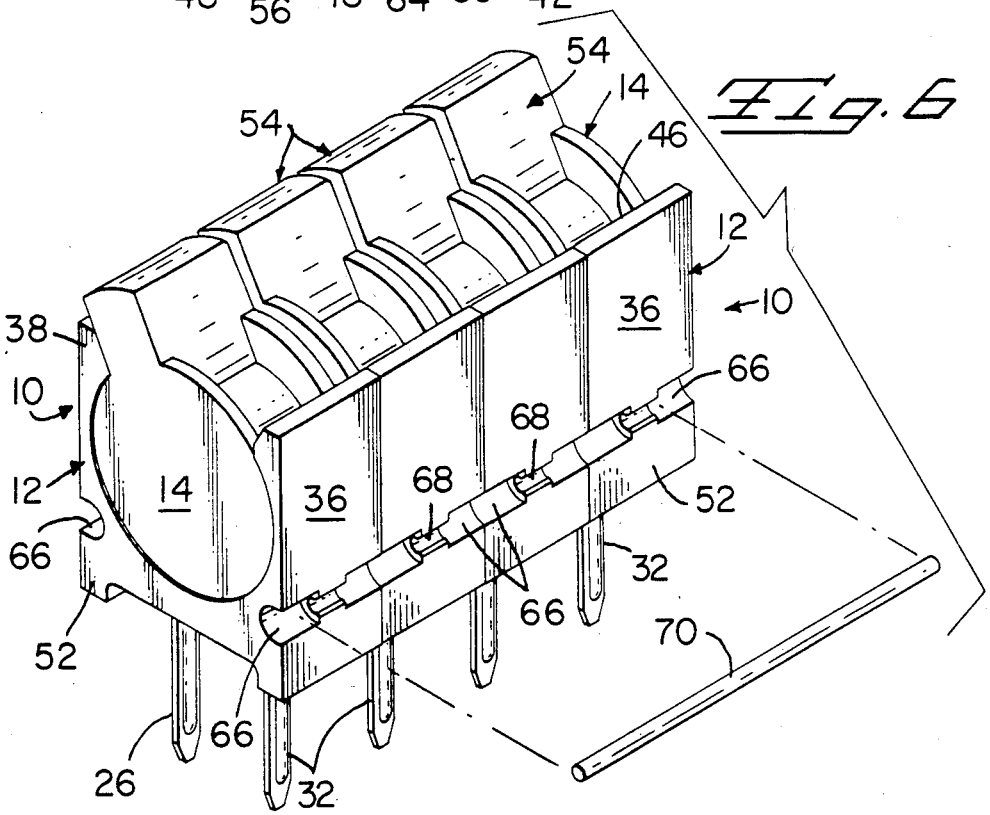
FIG. 6 is a perspective view of several switches grouped together with a rod exploded therefrom that secures the group of switches together.

The sides of housing 12 have U-shaped recesses 66 therein and smaller U-shaped recesses are centrally located within recesses 66. Switches 10 can be ganged together as shown in FIG. 6 and are maintained in the ganged condition by insertion of a plastic rod within U-shaped recesses 68 in each of housings 12. Plastic rod 70 has a diameter enabling it to be snapped into recesses 68 and the ends of rod 70 within recesses 66 of the outermost housings 12 are disrupted by the application of heat thereby securing switches 10 in a ganged condition and mounted on a printed circuit board in such condition.

Figure 7:
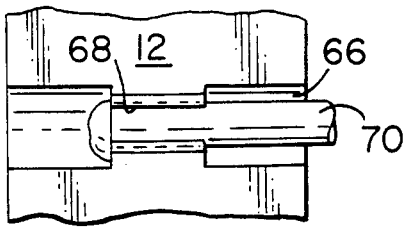
FIG. 7 is a part front elevational view of the leftmost switch of FIG. 6 illustrating the rod in position in the housing.
Figure 8:
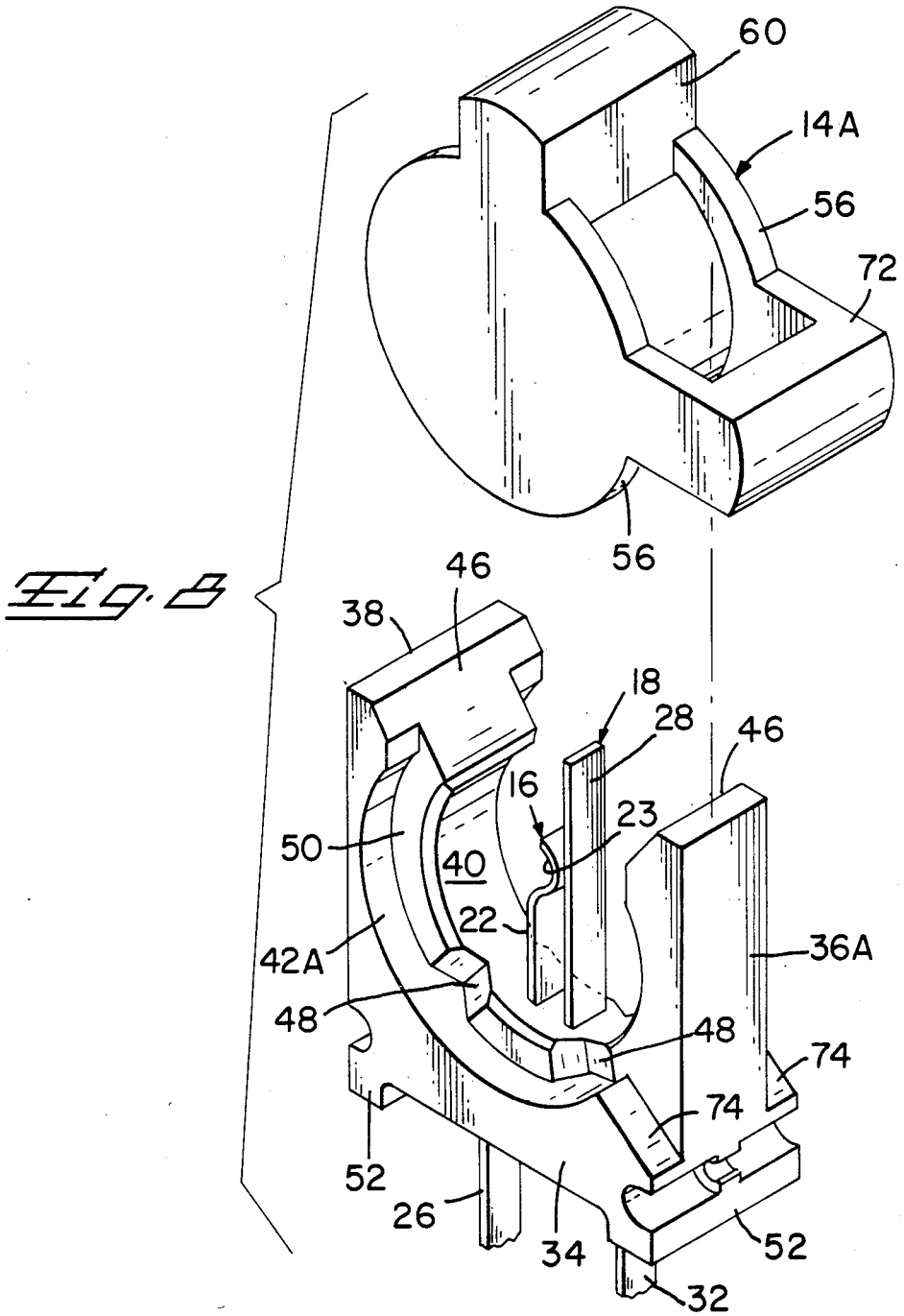
FIGS. 8 and 9 are views similar to FIGS. 1 and 2 showing an alternative embodiment of the invention.
Figure 9:
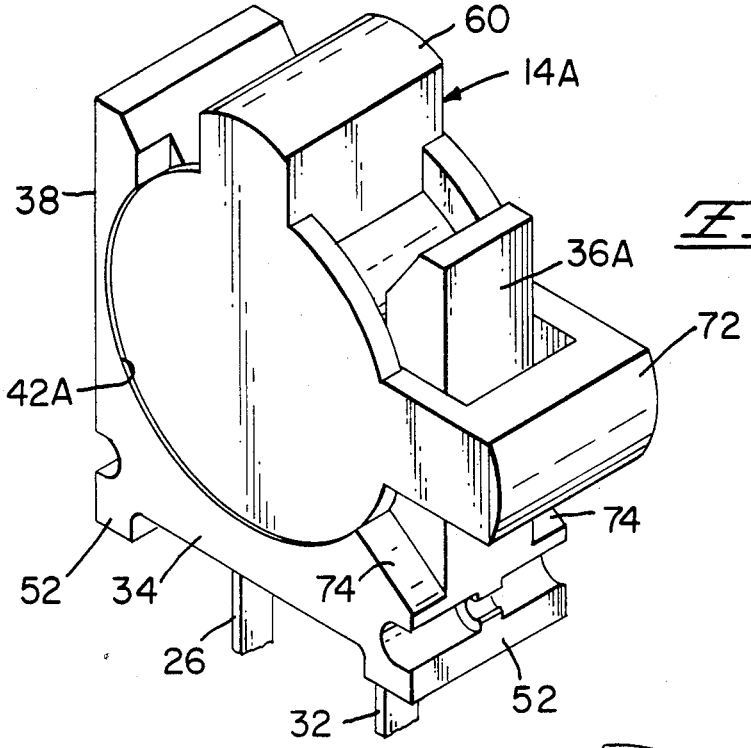
Figure 10:
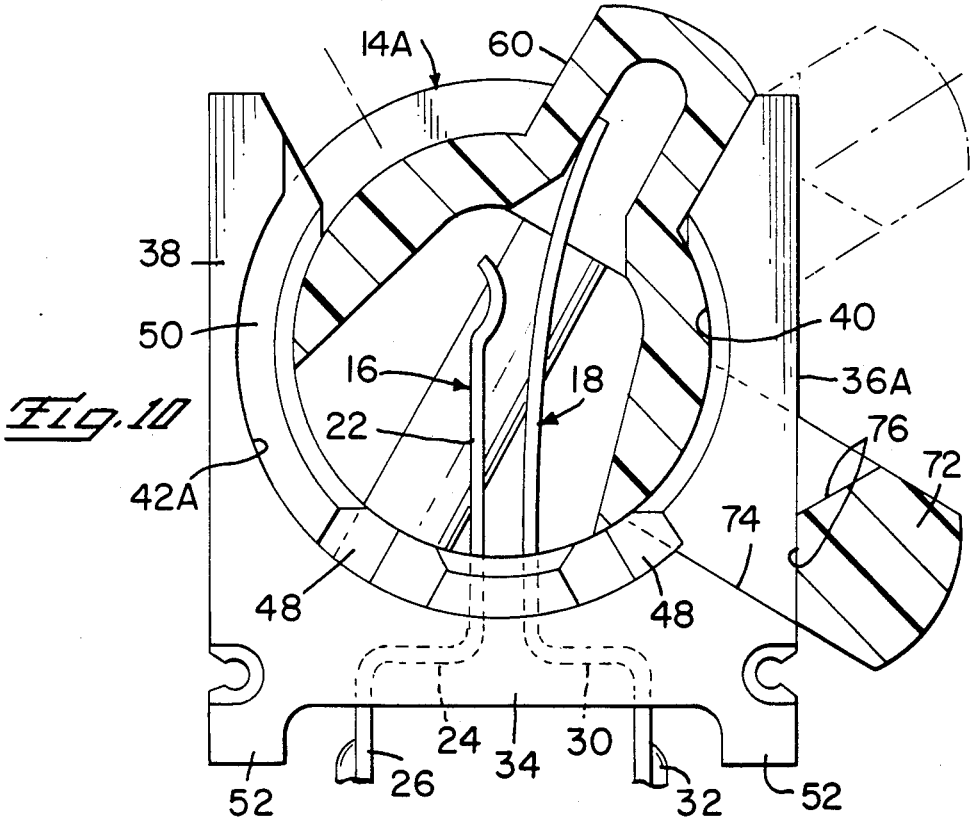
FIG. 10 is a view similar to FIG. 4B showing the switch of FIGS. 8 and 9 in a nonoperative position.

FIGS. 8 through 10 illustrate an alternative embodiment of switch 10 which is directed to a switch that can be mounted between printed circuit boards for side actuation thereof. In this embodiment, resilient section 36A is narrowed to accommodate U-shaped section 72 of actuator 14A which extends outwardly as part of outer sections 56 and is positioned at right angles with respect to operating section 60. Outer arcuate surface 42A and the other outer radiussed surface (not shown) intersect with tapered surfaces 74 adjacent resilient section 36A which are engaged by the side legs of U-shaped section 72 when actuator 14A is in a nonactuated position as shown in FIG. 10. The bottom leg of U-shaped section 72 is engaged by an actuating member to move actuator 14A from an actuated position to a nonactuated position and inner tapered surfaces 76 of the bottom leg engage against the outer surface of resilient section 36A in one or the other positions. The switch of FIGS. 8 through 10 is otherwise the same as switch 10 of FIGS. 1 through 5 and can be ganged in the same manner as shown in FIGS. 6 and 7 as well as being operated from a top or side position.

Figure 11B:
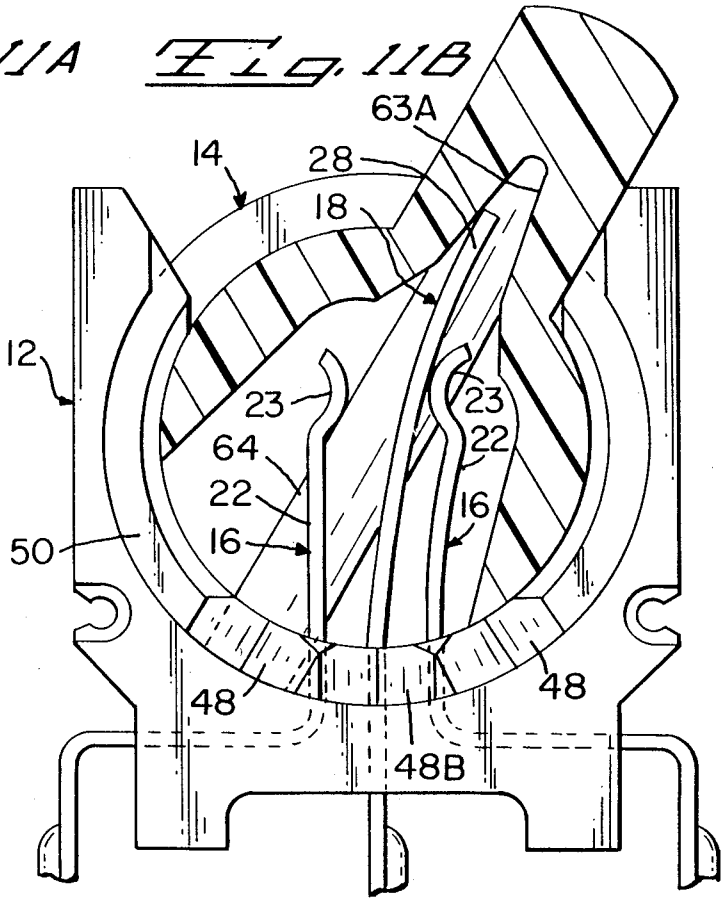
FIGS. 11A and 11B are views similar to FIGS. 4A and 4B showing a further embodiment of the invention.
Figure 11A:
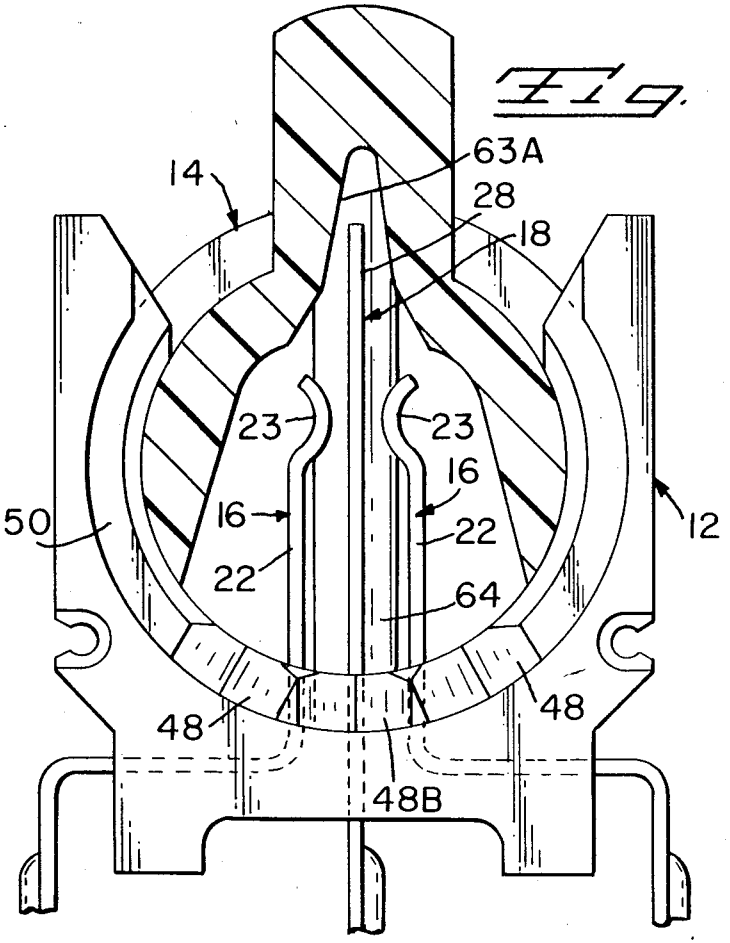

FIGS. 11A and 11B illustrate a further embodiment of the switch which represents a single-pole double-throw switch that is the same as the switches illustrated in FIGS. 1 through 5 and 8 through 10 except that, in this switch, stationary contact sectins 22 of electrical contact members 16 are monted in housing 12 on each side of movable contact section 28 of electrical contact member 18 so that actuator 14 can move movable contact section 28 in cavity part 63A into wiping electrical engagement with arcuate contact sections 23 in a first or a second actuated position and V-shaped recesses 48B are located in surfaces 50 between recesses 48 so that when radiussed projections 64 are disposed in recesses 48B as shown in FIG. 11A, actuator 14 will be in a neutral position with movable contact section 28 being out of engagement with either of arcuate contact sections 23. The switch of 11A and 11B is otherwise the same as the switches of FIGS. 1 through 5 and 8 through 10 and operates in the same manner, as well as being able to be ganged together in like manner as the other switches. Also, the embodiment of FIGS. 11A and 11B can have side actuation operating capability in the same manner as the switch of FIGS. 8 through 10.

An electrical switch has been disclosed that is of simple structure, the part are easy to manufacture and they can be readily assembled into switches that can be tested while in strip form and thereafter the strip can be used to feed them to an insertion location for insertion onto printed circuit boards. The switches can be grouped together and they can be operated from above or to the side.

I claim:

1. An electrical switch comprising a dielectric housing having electrical contact members secured therein including stationary and movable contact sections, a dielectric actuator movably mounted on the housing for moving the movable contact section into and out of electrical engagement with the stationary contact section, and a detent arrangement for maintaining the actuator in a first or second position, characterized in that:

said housing having a base, resilient sections extending outwardly from said base, a profiled arcuate inner surface formed on said base and resilient sections with the stationary and movable contact sections being located in and extending outwardly from said arcuate inner surface; and said actuator having a cavity and an external arcuate surface matable with said arcuate inner surface, said surfaces movable relative to each other when said actuator has been mounted on said housing, stationary and movable contact sections disposed in said cavity, said resilient sections of said housing maintaining said actuator on said housing, said movable contact section being disposed in a section of said cavity and is movable into and out of electrical engagement with said stationary contact section upon movement of said actuator from the first position to the second position.

2. An electrical switch as claimed in claim 1, charcterized in that said detent arrangement comprises spaced recesses in said actuator or housing and radiussed projections on said housing or actuator.

3. An electrical switch as claimed in claim 1, characterized in that said housing has outer arcuate surfaces along which outer arcuate sections of said actuator are movably disposed.

4. An electrical switch as claimed in claim 1, characterized in that said contact members have terminal sections extending outwardly from said housing for electrical connection with respective conductive paths on a printed circuit board.

5. An electrical switch as claimed in claim 1, characterized in that stationary contact sections are disposed on both sides of said movable contact section.

6. An electrical switch as claimed in claim 1, characterized in that one resilient section is narrower than the other and said actuator includes a U-shaped member through which said narrow resilient section extends, said U-shaped member being disposed at right angles with respect to an operating section of said actuator.

7. An electrical switch as claimed in claim 1, characterized in that said housing includes means for connecting said housing to other switch housings thereby grouping the switches together.

8. An electrical switch, comprising:

a dielectric housing having a base and resilient sections along which an inner arcuate surface extends;

electrical contact members having mounting sections secured in said housing and stationary and movable contact sections of said contact members disposed in said inner arcuate surface and extending outwardly therefrom for electrical engagement with each other;

a dielectric actuator disposed within said housing between said resilient sections and having a cavity in which said contact sections are disposed and arcuate surface means matable with said inner arcuate surface, said resilient sections maintaing said actuator in position on said housing, said movable contact section being disposed in a section of said cavity and engageable with said actuator, and said actuator having an actuating section for moving said actuator from one position at which said movable contact section is out of electrical engagement with said stationary contact section to another position at which said movable contact section is in electrical engagement with said stationary contact section.

9. An electrical switch as claimed in claim 8, wherein detent means are provided between said housing and said actuator for maintaining said actuator in said one or said other position.

10. An electrical switch as claimed in claim 8, wherein said actuator has outer arcuate sections matable with outer arcuate surfaces of said housing adjacent said inner arcuate surface which stabilize said actuator on said housing.

11. An electrical switch as claimed in claim 8, wherein another actuating section of said actuator encompasses one of the resilient sections and is movable relatively therealong.

12. An electrical switch as claimed in claim 8, wherein stationary contact sections are diposed on both sides of said movable contact section.

13. An electrical switch as claimed in claim 8, wherein said housing includes means for connecting said housing to other switch housings forming the electrical switches in a group.

14. An electrical switch as claimed in claim 13, wherein said connecting means comprises recesses in said housings in which a rod is frictionally disposed.

* * * * *